US008511982B2

(12) United States Patent
Hart et al.

(10) Patent No.: US 8,511,982 B2
(45) Date of Patent: Aug. 20, 2013

(54) COMPRESSOR VANE DIAPHRAGM

(75) Inventors: Adam L. Hart, Stuart, FL (US); Charles A. Ellis, Stuart, FL (US); Elliot I. Goodman, Jupiter, FL (US); W. David Day, Jupiter, FL (US); Gerald Raresheid, Port St. Lucie, FL (US); James Page Strohl, Stuart, FL (US)

(73) Assignee: Alstom Technology Ltd., Baden (CH)

( * ) Notice: Subject to any disclaimer, the term of this patent is extended or adjusted under 35 U.S.C. 154(b) by 553 days.

(21) Appl. No.: 12/623,940

(22) Filed: Nov. 23, 2009

(65) Prior Publication Data

US 2010/0129211 A1 May 27, 2010

Related U.S. Application Data

(60) Provisional application No. 61/117,313, filed on Nov. 24, 2008.

(51) Int. Cl.
*F01D 9/04* (2006.01)

(52) U.S. Cl.
USPC ..... 415/209.2; 415/209.4; 415/210.1

(58) Field of Classification Search
USPC ..... 415/209.3, 209.4, 210.1, 209.2; 416/190, 416/191, 194, 195
See application file for complete search history.

(56) References Cited

U.S. PATENT DOCUMENTS

| | | | | | |
|---|---|---|---|---|---|
| 2,654,566 | A * | 10/1953 | Boyd et al. | 415/137 |
| 3,837,761 | A * | 9/1974 | Brown | 416/191 |
| 4,015,910 | A * | 4/1977 | Harmon et al. | 415/209.4 |
| 4,492,517 | A * | 1/1985 | Klompas | 415/139 |
| 4,521,159 | A * | 6/1985 | Pask | 416/174 |
| 4,553,901 | A * | 11/1985 | Laurello | 415/138 |
| 4,645,217 | A * | 2/1987 | Honeycutt et al. | 277/555 |
| 4,832,568 | A * | 5/1989 | Roth et al. | 415/189 |
| 4,889,470 | A * | 12/1989 | Scalzo | 415/209.2 |
| 5,957,658 | A * | 9/1999 | Kasprow et al. | 415/134 |
| 6,050,776 | A * | 4/2000 | Akagi et al. | 415/209.4 |
| 6,261,058 | B1 * | 7/2001 | Kataoka et al. | 415/189 |
| 6,524,065 | B2 * | 2/2003 | Briesenick et al. | 415/173.7 |
| 7,331,755 | B2 * | 2/2008 | Broderick et al. | 415/191 |
| 7,857,582 | B2 * | 12/2010 | Kovac et al. | 415/173.7 |
| 8,128,354 | B2 * | 3/2012 | Hansen et al. | 415/191 |
| 2002/0044868 | A1 * | 4/2002 | Marx et al. | 415/191 |
| 2006/0197287 | A1 * | 9/2006 | Farah et al. | 277/549 |

* cited by examiner

*Primary Examiner* — Edward Look
*Assistant Examiner* — Liam McDowell
(74) *Attorney, Agent, or Firm* — Shook, Hardy & Bacon L.L.P.

(57) ABSTRACT

A compressor diaphragm for a gas turbine engine having improved wear capability, manufacturability, and assembly techniques is disclosed. The diaphragm includes a shiplap-type joint at an outer vane platform for connecting to adjacent vane assemblies and a clamshell-like assembly of a seal box secures and seals regions around the inner vane platform of the compressor diaphragm so as to reduce wear between the seal box and the vane assemblies. The inner platform of the diaphragm segments are fastened to each other through circumferentially-oriented fasteners at the inner diameter platform.

7 Claims, 11 Drawing Sheets

COMPRESSOR VANE DIAPHRAGM

CROSS REFERENCE TO RELATED APPLICATIONS

This application claims priority to U.S. Provisional Patent Application Ser. No. 61/117,313, filed on Nov. 24, 2008.

TECHNICAL FIELD

The present invention generally relates to a compressor diaphragm and vane configuration. More specifically, the compressor vane diaphragm includes improved assembly techniques that reduces operating stresses and wear at mating surfaces between adjacent compressor vanes.

BACKGROUND OF THE INVENTION

Gas turbine engines operate to produce mechanical work or thrust. Specifically, land-based gas turbine engines typically have a generator coupled thereto for the purposes of generating electricity. A gas turbine engine comprises an inlet that directs air to a compressor section which has stages of rotating compressor blades spaced between stage of stationary vanes. As the air passes through the compressor, the pressure of the air increases. The compressed air is then directed into one or more combustors where fuel is injected into the compressed air and the mixture is ignited. The hot combustion gases are then directed from the combustion section to a turbine section. As the hot combustion gases pass through the turbine, the stages of the turbine rotate, which in turn, causes the compressor to rotate.

The air from the inlet is directed through a compressor section, with the compressor having a plurality of alternating axial stages of rotating blades and stationary vanes. As the air travels through the compressor, its pressure increases as well as its temperature. An axial stage of vanes and mounting hardware forms a diaphragm that is secured to the engine and directs the flow of air onto the compressor blades. In prior designs, circular inner diameter and outer diameter rings were used with slots cut through the rings for airfoils to slide through the slots. The airfoils were then welded to the rings to form the vane diaphragms. The full-circle rings and vanes were split into two, 180-degree segments and each of these segments was then assembled into an engine. This assembly has numerous drawbacks including manufacturing and production issues, airfoil cracking at the weld joints during operation, and durability issues regarding seals associated with the diaphragm assembly.

SUMMARY

In accordance with the present invention, there is provided a novel configuration for a gas turbine engine compressor diaphragm having a plurality of vane segments fastened together to form a vane pack along with a clam shell-type seal box. The vane pack has a plurality of elastomeric seals located at the interfaces between fastened vane segments. The vane pack also engages a seal box at its inner diameter, the seal box having a forward and aft seal carrier portions coupled together and to the compressor diaphragm.

In an embodiment of the present invention, a vane pack assembly for a gas turbine comprises a plurality of vane assemblies coupled together by a first plurality of fasteners. The vane assemblies have an outer platform with a connecting plate extending from a first side and a recessed portion along the opposite side, an inner platform and one or more airfoils extending therebetween. Each of the connecting plates has a plurality of holes that correspond to a plurality of threaded holes in the recessed portion when a connecting plate is placed over a recessed portion of an adjacent vane assembly. The recessed portion in the outer platform also corresponds generally in dimension and shape to the connecting plate. A plurality of fasteners pass through the plurality of holes in the connecting plate and secure the connecting plate in the recessed portion through the plurality of threaded holes in the recessed portion. The vane pack assembly also includes an elastomeric seal that is located in the recessed portion to provide both sealing and vibration dampening capabilities.

In an alternate embodiment, an improved seal box for engaging a plurality of vane assemblies is provided that does not require modifications to an existing compressor case. The seal box is a region around the inner diameter of a vane pack assembly adjacent to a rotating disk. The seal box provides for increased durability at hook portions, increased damping in conjunction with the vanes, and improved assembly techniques. The seal box comprises a forward seal carrier segment having a first forward radially extending wall connected to a second forward radially extending wall by a first generally axial portion and an aft seal carrier segment having a first aft radially outward extending wall connected to a first aft radially inward extending wall by a second generally axial portion. The seal carrier segments are secured together by a plurality of fasteners passing through the first aft radially inward extending wall and the second forward radially extending wall so as to couple the forward seal carrier and aft seal carrier together and to a vane assembly.

In yet another embodiment of the present invention, an elastomeric seal for use in a compressor diaphragm is also disclosed. The elastomeric seal comprises a first sheet of metal, a silicone sheet, and a second sheet of metal. The silicone sheet is impregnated with fiberglass and is bonded to the first and second sheets of metal to form a reinforced solid bonded seal. The seal is generally used in a joint interface between mating platform portions of vane assemblies, such as between the connecting plate and recessed portions of the outer platform of a vane.

In a further embodiment of the present invention, a method of assembling a compressor diaphragm is disclosed. Adjacent vane assemblies are coupled together at the interface of connecting plates and recessed portions of the outer platforms and at the inner platforms by a plurality of fasteners. The resulting diaphragm assembly is then placed in a forward seal carrier segment and an aft seal carrier segment is then placed onto the diaphragm assembly. The seal carrier segments are then fastened to the diaphragm assembly.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
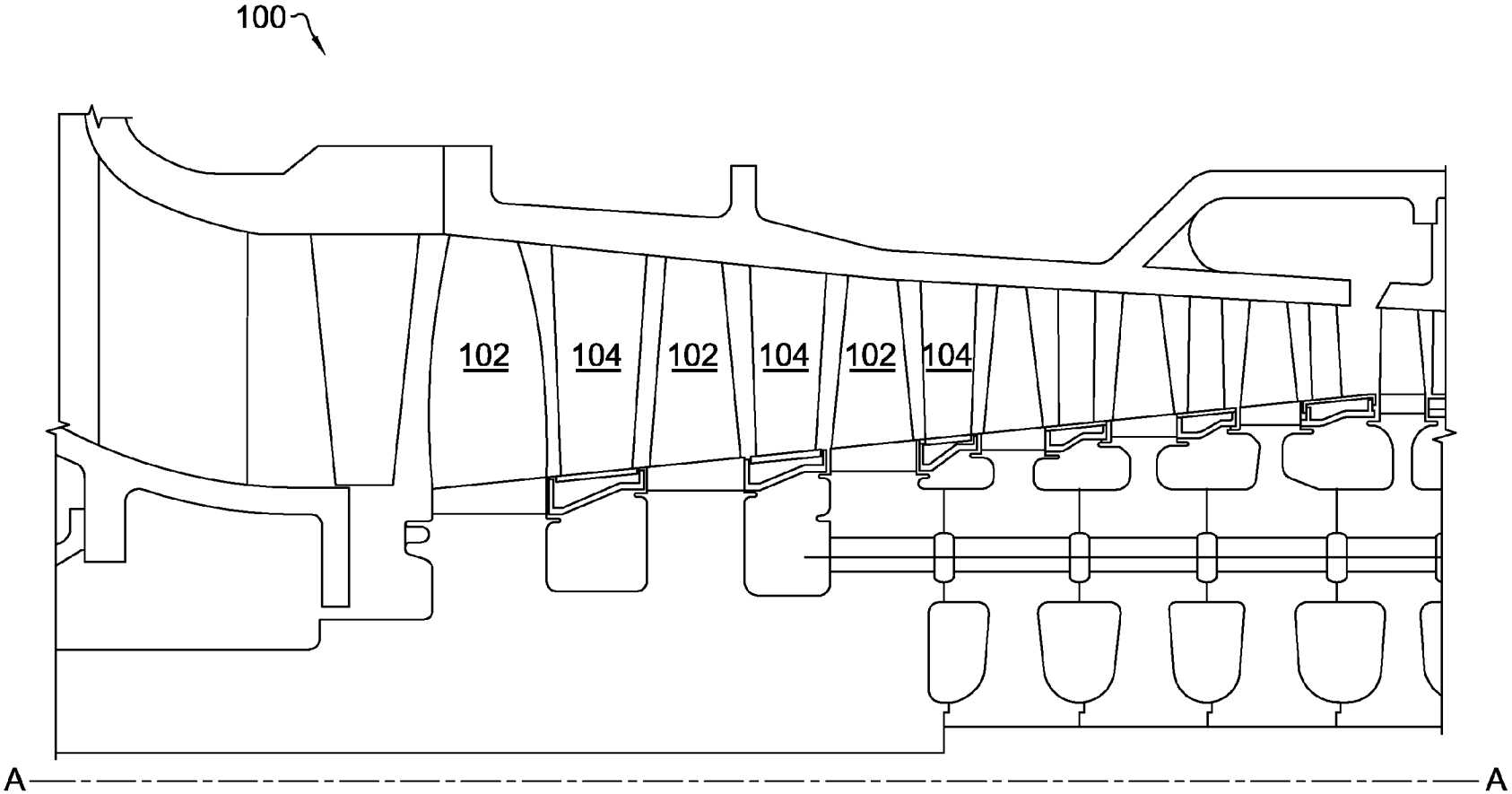
FIG. 1 is a cross section of a portion of a compressor incorporating an embodiment of the present invention.

Referring initially to FIG. 1, a cross section of a portion of a gas turbine compressor is depicted. The compressor 100 includes a plurality of alternating stages of rotating compressor blades 102 and stationary stages of compressor vanes 104. The stationary vanes 104 receive compressed air from a stage of rotating blades 102 and redirect the air in the proper direction towards a subsequent stage of rotating blades 102. The compressor 100 serves to increase the pressure and temperature of air passing through it by passing the air through an increasingly smaller volume at each subsequent stage of the compressor 100.

Figure 2:
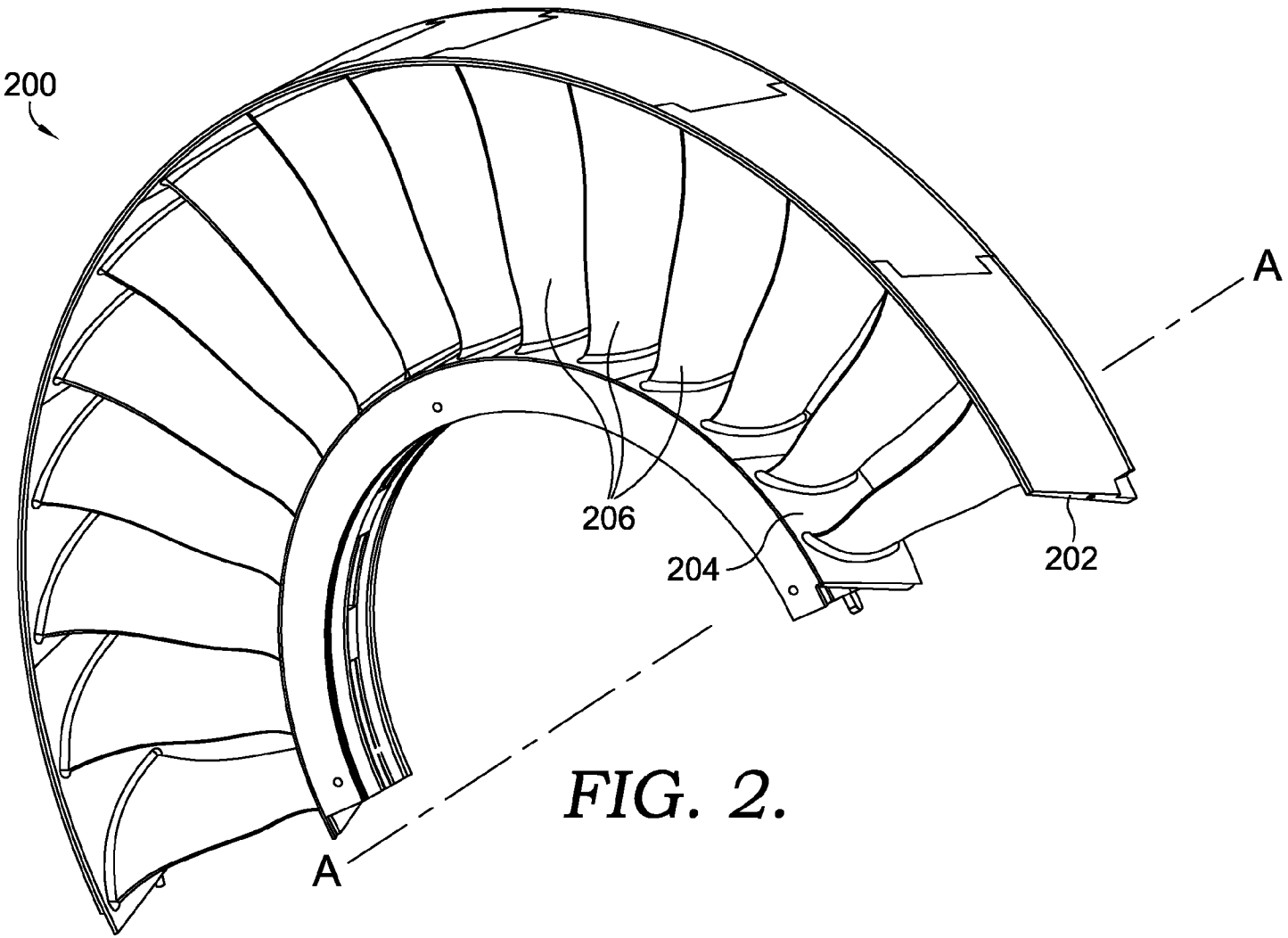
FIG. 2 is a perspective view of an embodiment of the present invention.
Figure 3:
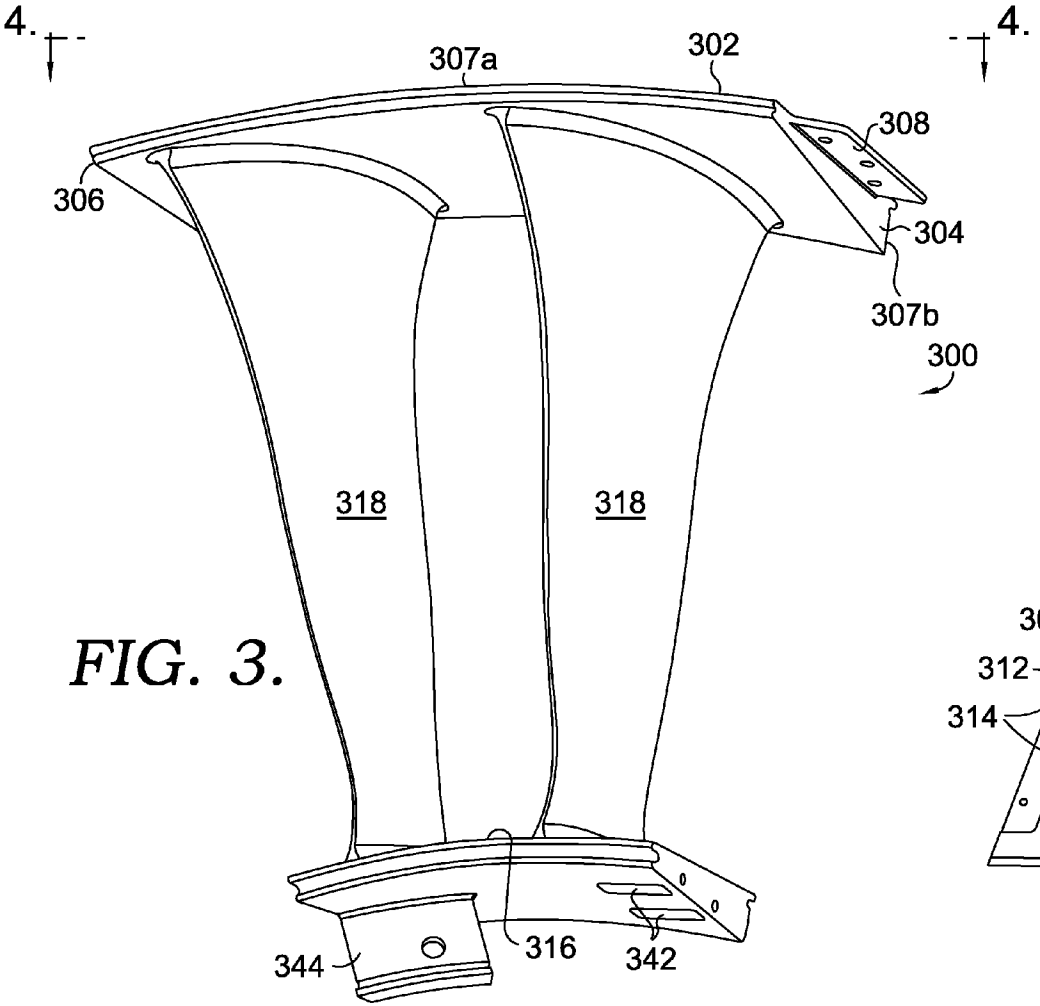
FIG. 3 is a perspective view of a vane assembly of a compressor diaphragm in accordance with an embodiment of the present invention.
Figure 4:
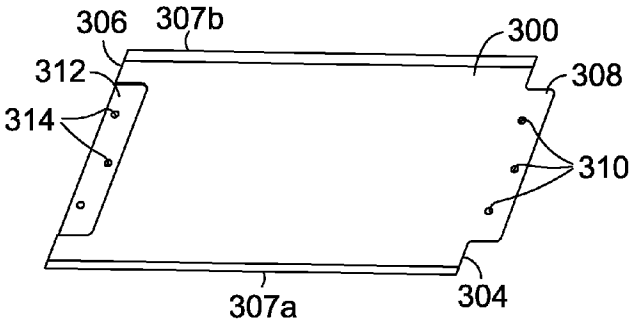
FIG. 4 is a top elevation view of the vane assembly of FIG. 3 in accordance with an embodiment of the present invention.

A compressor diaphragm in accordance with an embodiment of the present invention is shown in FIGS. 2-7. Referring to FIG. 2, the vane pack assembly 200 typically includes a radially outer surface 202, relative to an engine centerline A-A, a radially inner surface 204, and a series of airfoils 206 spaced between the surfaces. The outer surface 202 is formed from a series of outer vane platforms that are arc-shaped. These assemblies are exposed to varying temperatures, pressures, and vibrations that can wear and degrade over time. An individual vane assembly 300 used in the vane pack assembly 200 is shown in FIG. 3. The vane assembly 300 includes an outer vane platform 302 having a first sidewall 304, an opposing second sidewall 306, a forward wall 307*a*, and an aft wall 307*b*. The outer vane platform 302, also includes a connecting plate 308 that extends away from the first side wall 304. In FIG. 4, a top elevation view of a vane assembly 300 is shown where the connecting plate 308 has a plurality of through holes 310. The outer platform 302 also has a recessed portion 312 adjacent the second sidewall 306 with the recessed portion 312 having a plurality of threaded holes 314. An inner vane platform 316 is spaced radially inward from the first outer platform 306. One or more airfoils 318 extend between the platforms 302 and 316, with a flange 344 extending radially inward from the inner vane platform 316. The one or more airfoils are preferably integral to the inner vane platform 316 and outer vane platform 302.

Figure 5:
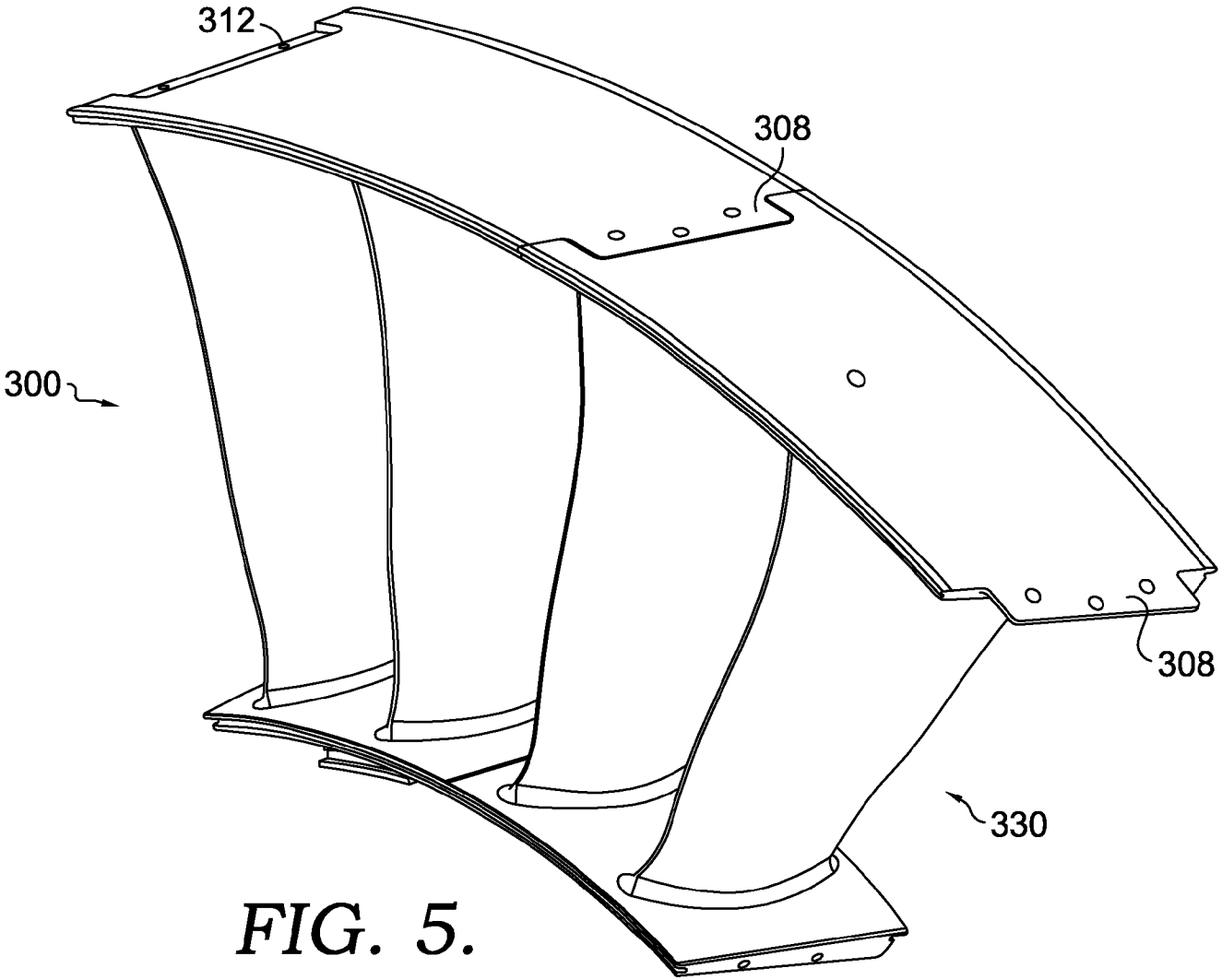
FIG. 5 is a perspective view of a partial assembly of components of a diaphragm assembly in accordance with an embodiment of the present invention.
Figure 6:
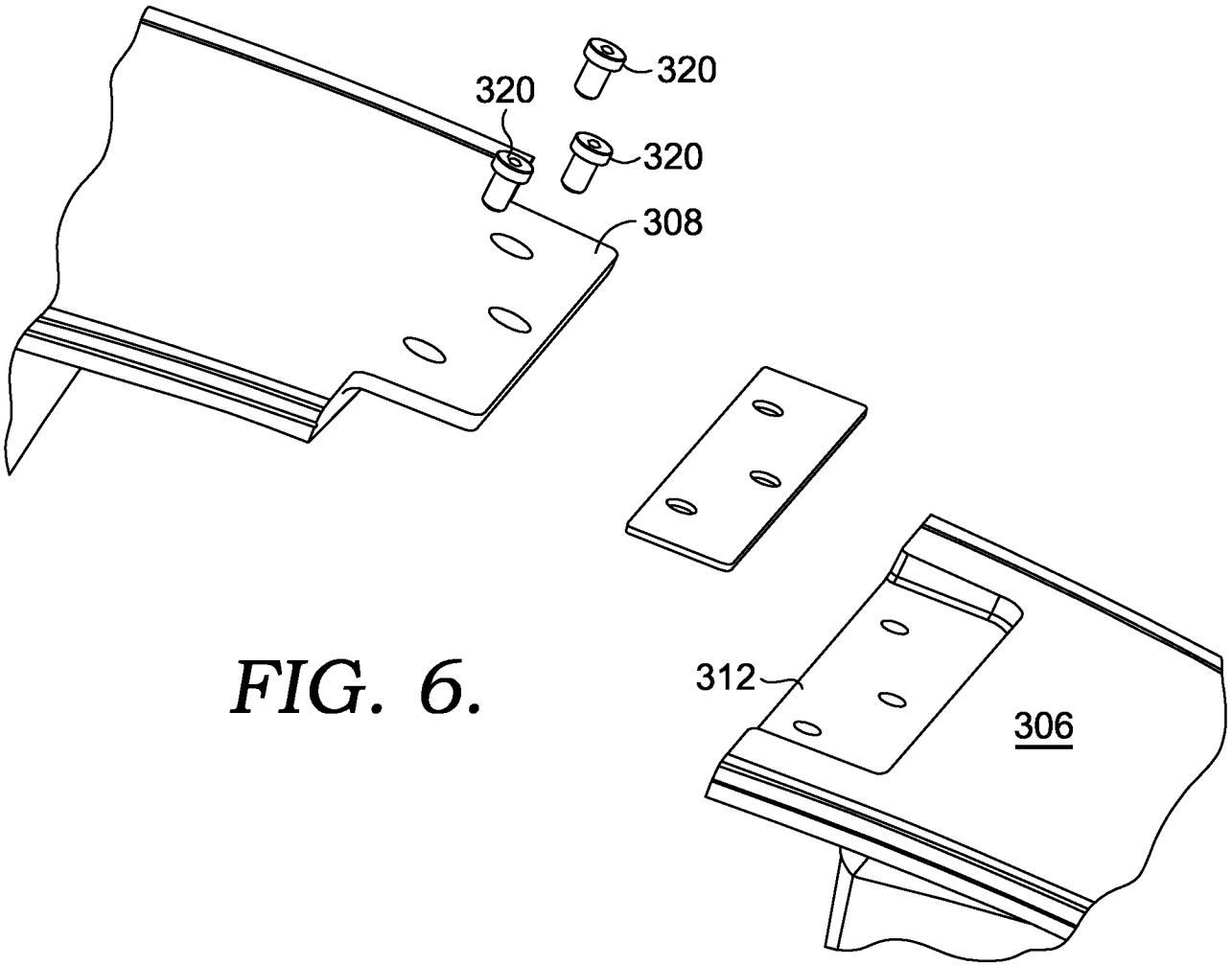
FIG. 6 is an exploded view of a portion of a compressor diaphragm in accordance with an embodiment of the present invention.

To secure the vane assembly 300 to an adjacent vane assembly 330, as depicted in FIG. 5, the connecting plate 308 is placed within the recessed portion 312 of the adjacent vane assembly 330 such that the holes 310 and 314 overlay on each other. The vane assembly 300 can be fastened to the adjacent vane assembly 330 with a plurality of fasteners 320, such as a screw or bolt that can be removed for purposes of overhaul and repair of the individual vane assemblies. An exploded view of the diaphragm components at the outer vane platform joint is shown in FIG. 6. By dividing the overall compressor diaphragm into individual segments instead of half-ring segments, manufacturability and durability are improved since platforms and airfoils can be integrally cast and greater manufacturing tolerances can be controlled. Also, vibrations of the fastened assembly are controlled since the joint formed by the connecting plate 308 and recessed portion 312 is capable of having an elastomeric seal located therebetween. Features of an acceptable elastomeric seal are discussed below.

In order to minimize any gaps between adjacent vane assemblies 300 and 330, the segments are also fastened to each other at the inner vane platform 316, with the fasteners 340 extending in a generally circumferential direction. The fasteners 340 connect adjacent inner platforms 316 through a recessed portion 342 in the inner platform 316 (see FIGS. 3 and 10). The fasteners 340 pass through openings in a sidewall of the inner vane platform 316 and extend to engage threaded holes of an adjacent inner vane platform 316 such that the fasteners 340 are generally perpendicular to the fasteners 320 which secure outer vane platforms 302 together. As a result of the geometric tolerances that are able to be held during manufacturing and use of fasteners 340 and 320 on the inner platform and outer platform, respectively, the individual vane assemblies 300 form a relatively smooth arc-shape diaphragm assembly free from steps between adjacent platforms.

The quantity of airfoils 306 that extend between the platforms 302 and 316 can vary. Vane assemblies 300 can have a single airfoil, two airfoils (doublets), or three airfoils (triplets) extending between the platforms, depending on the engine geometry The embodiment depicted in FIG. 3, shows a doublet arrangement.

Figure 7:
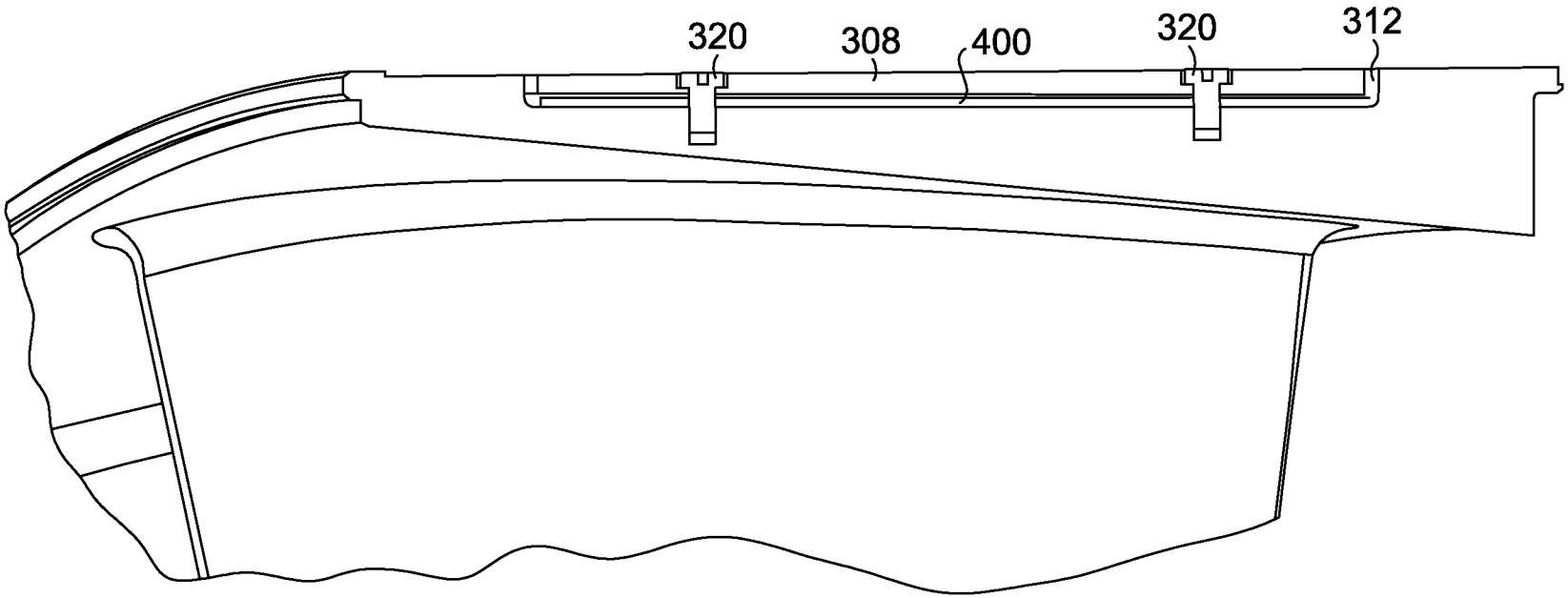
FIG. 7 is a cross section view of a joint between a connecting plate and a recessed portion of an outer platform in accordance with an embodiment of the present invention.
Figure 11:
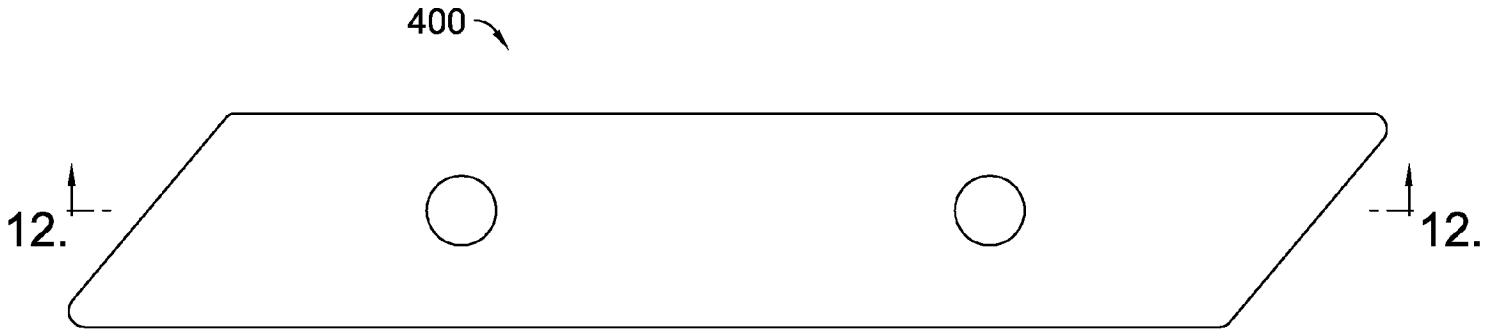
FIG. 11 is a top elevation view of an elastomeric seal in accordance with an embodiment of the present invention.
Figure 12:
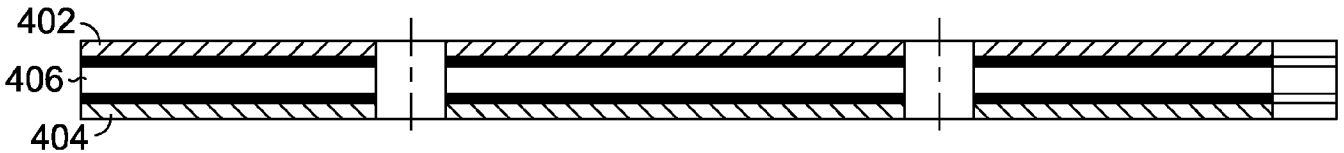
FIG. 12 is a cross section view of the elastomeric seal of FIG. 11.

Referring to FIG. 7, a seal 400 is located between the connecting plate 308 a bottom surface of the recessed portion 312. The seal 400 provides for a flexible contact surface between a connecting plate 308 and recessed portion 312 of adjacent vane assemblies. This contact surface also serves as a damper given its multi-layer composite construction. The seal 400, which is shown in more detail in FIGS. 11 and 12, comprises a first sheet of metal 402 having a first thickness, a second sheet of metal 404 having a second thickness, and an elastomeric sheet 406 positioned between the first and second sheets 402 and 404, where the elastomeric sheet 406 is fiber reinforced. The elastomeric layer 406 provides flexibility to the seal 400 while the reinforcing fiber provides the necessary structural rigidity. The reinforced elastomer is bonded to the metal sheets 402 and 404 by an adhesive compound. In one embodiment, the metal plates consist of a stainless steel, but the material selection for the metal can vary depending on desired flexibility and temperature of the seal. For the embodiment of the present invention shown in FIG. 7, the seal 400 is approximately 0.062 inches thick, but the thickness can vary depending on the geometry of the connecting plate 308 and recessed portion 312. The respective thickness of the metal sheets 402 and 404 will also vary depending on the desired stiffness of the seal 400.

Figure 8:
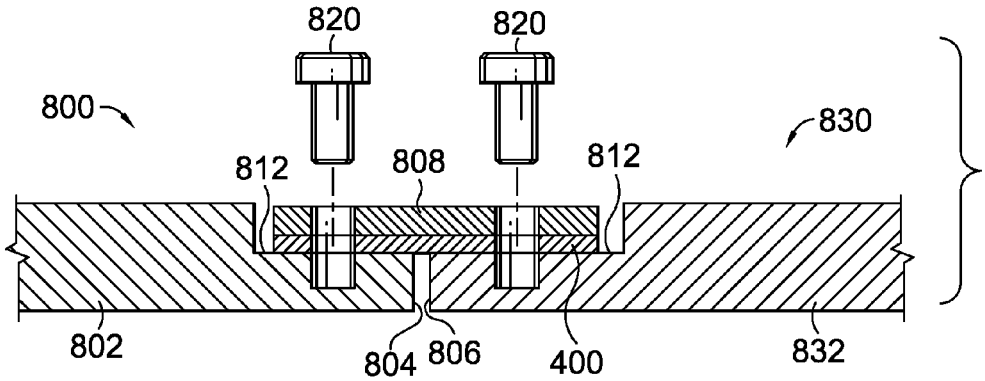
FIG. 8 is a view of a joint between a connecting plate and the outer platform having multiple recessed surfaces in accordance with an alternate embodiment of the present invention.
Figure 9:
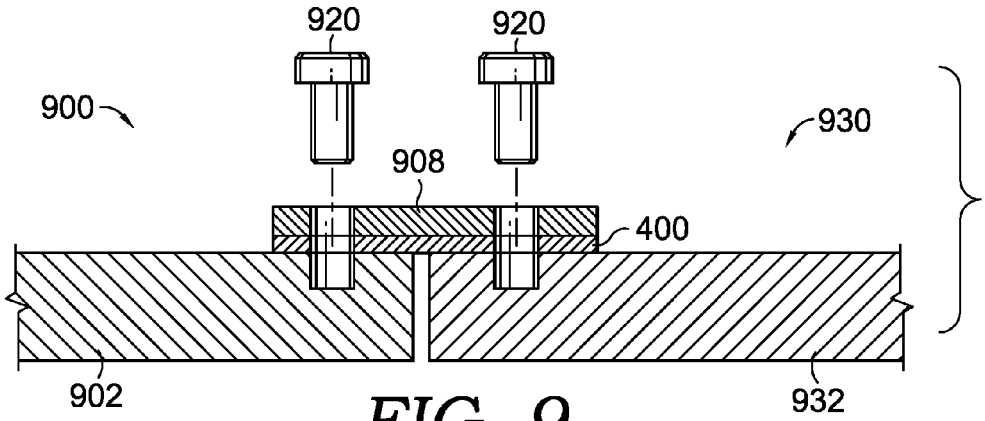
FIG. 9 is a view of a joint between a connecting plate and the outer platform in accordance with an alternate embodiment of the present invention.
Figure 10:
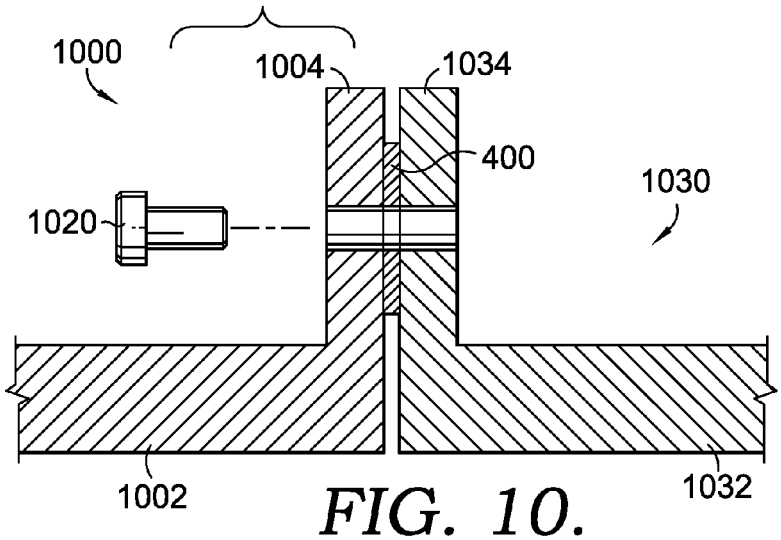
FIG. 10 is a view of a joint located along radially extending edges of platforms in accordance with yet another alternate embodiment of the present invention.

Referring to FIGS. 8-10, alternate embodiments of the outer vane platform region are shown. In FIG. 8, a portion of vane assemblies 800 and 830 are shown at the outer vane platforms 802 and 832. In this embodiment, a recessed portion 812 is located adjacent the first sidewall 804 and the second sidewall 806, such that when vane assemblies 800 and 830 are positioned adjacent to one another, the recessed portions 812 are capable of receiving a connecting plate 808 for joining vane assembly 800 to vane assembly 830. Positioned between the connecting plate 808 and the recessed potions 812 is a seal 400. Similar to the embodiment disclosed in FIG. 6, the vane assembly 800 is secured to the adjacent vane assembly 830 by a plurality of fasteners 820 that pass through a plurality of holes in the seal 400 and secure within openings in the recessed portion 812 of the outer vane platforms 802 and 832.

Referring to FIG. 9, another alternate embodiment of the outer vane platform region is shown. A portion of vane assemblies 900 and 930 are shown at the outer vane platforms 902 and 932. In this embodiment, the outer vane platforms 902 and 932 do not include a recessed portion, such that the connecting plate 908 and seal 400 are secured directly to an outermost surface of the outer vane platforms 902 and 932. As with prior configurations, the connecting plate 908 and seal 400 are secured with a plurality of fasteners 920.

Referring to FIG. 10, yet another alternate embodiment for securing adjacent vane assemblies together is shown. A portion of vane assemblies 1000 and 1030 are shown at the outer vane platforms 1002 and 1032. In this embodiment, the outer vane platforms 1002 and 1032 each include a radially extending portion 1004 and 1034, respectively, such that the adjacent vane assemblies can be secured to each other by one or more fasteners 1020 that passes through the radially extending portions 1004 and 1034 and at least a seal 400.

Figure 13:
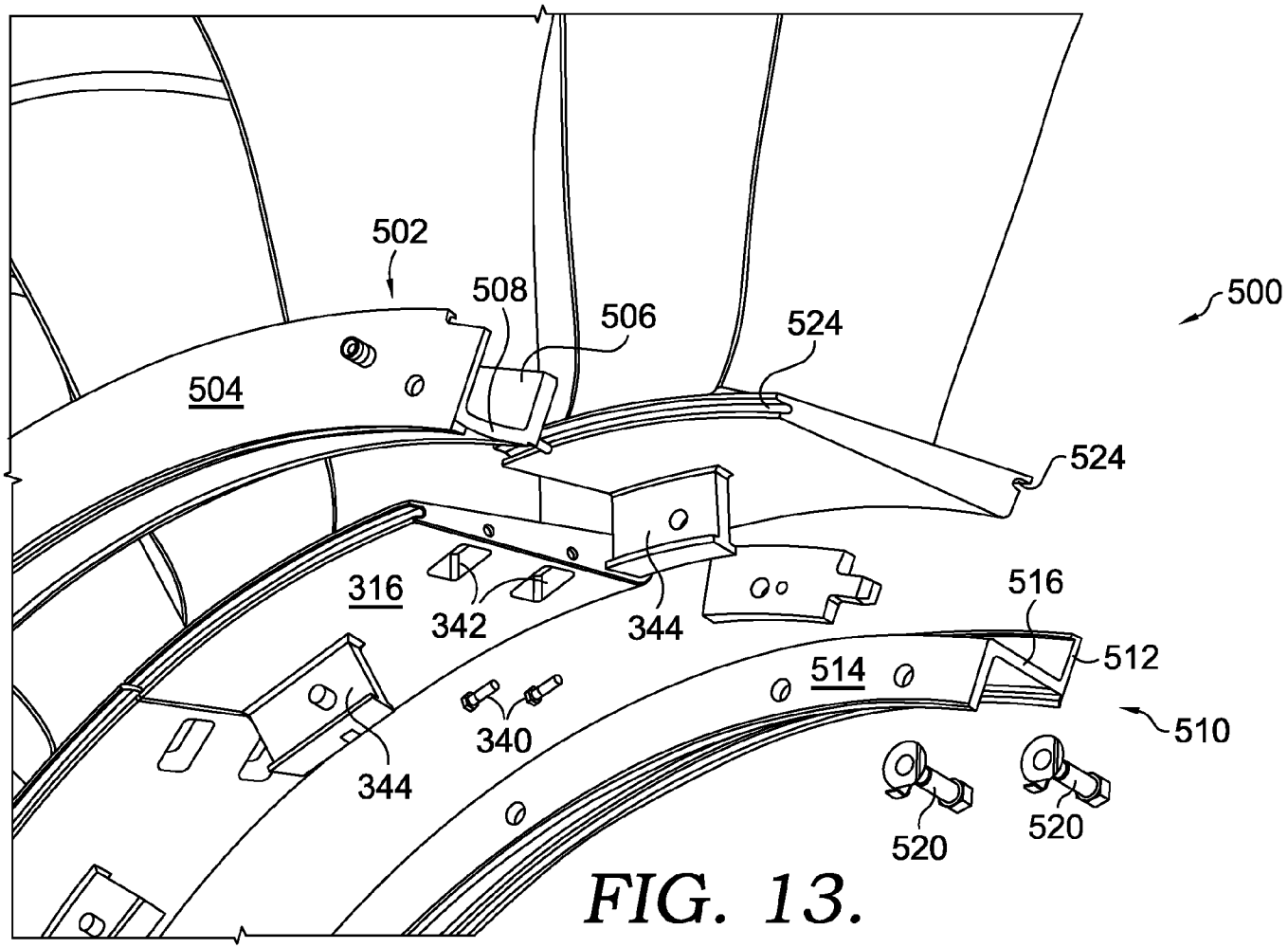
FIG. 13 is an exploded perspective view of the diaphragm to seal box interface in accordance with an embodiment of the present invention.
Figure 14:
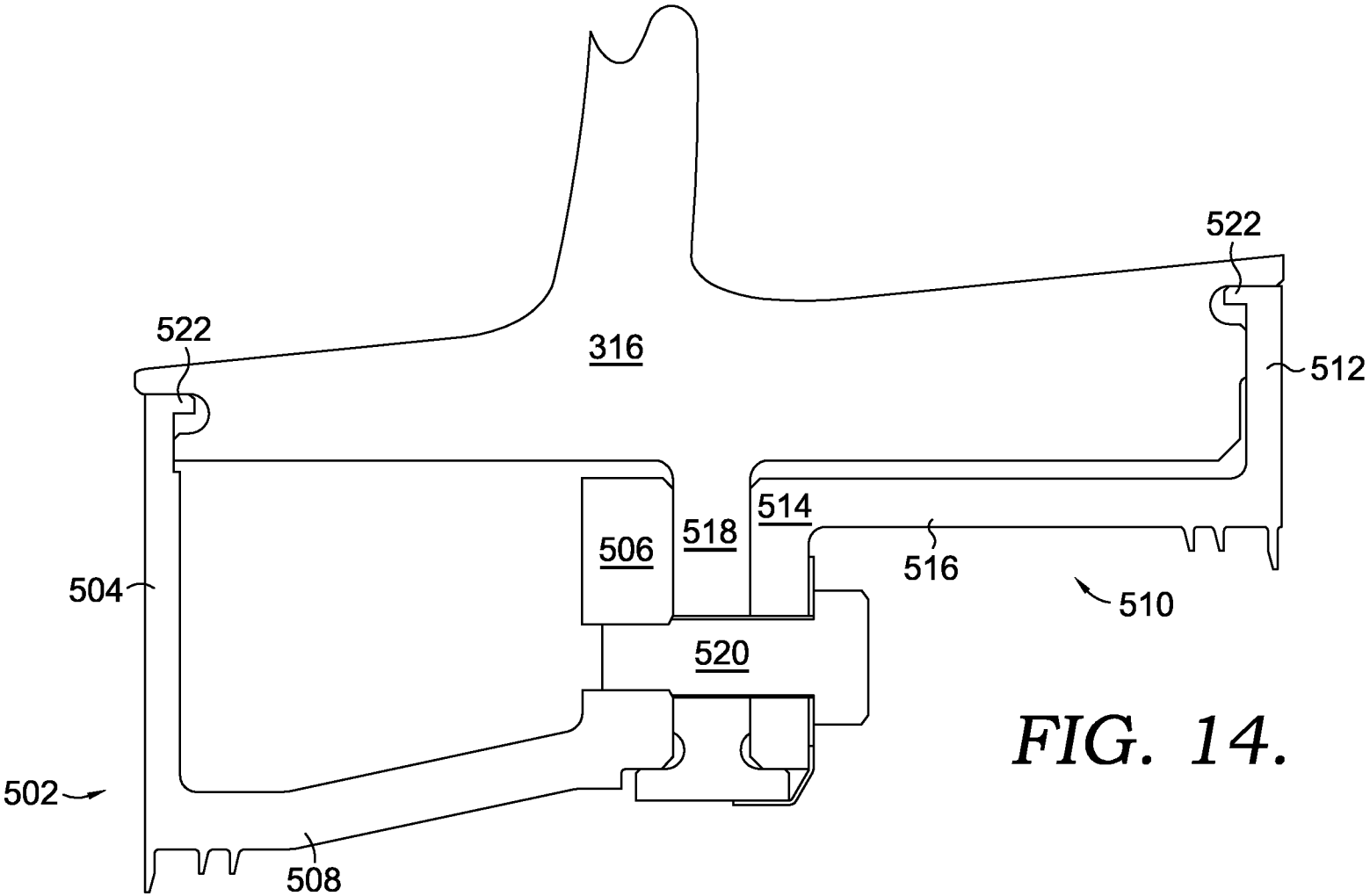
FIG. 14 depicts a cross section view of a the seal box in accordance with an embodiment of the present invention; and, FIG. 15 is a flow diagram depicting an assembly sequence for a diaphragm assembly in accordance with an embodiment of the present invention.

Referring now to FIGS. 13 and 14, a seal box 500 of the compressor diaphragm is depicted. Specifically, the seal box 500 includes a forward seal carrier segment 502 having a first forward radially extending wall 504 connected to a second forward radially extending wall 506 by a first generally axial portion 508. An aft seal carrier segment 510 has a first aft radially outward extending wall 512 connected to a first aft radially inward extending wall 514 by a second generally axial portion 516. When positioned around the inner vane platform 316 of the diaphragm, the forward seal carrier segment 502 and aft seal carrier segment 510 essentially sandwich the inner vane platform 316 and a connecting flange 344. The flange 344 is either an integrally machined feature of the inner vane platform 316 of each vane or welded to the inner vane platform 316. A plurality of fasteners 520 are placed through openings in the first aft radially inward extending wall 514, the flange 344, and the second forward radially extending wall 506 to secure the forward and aft seal carriers 502 and 510 in an axial direction. Through this fastening arrangement, each of the vane assemblies are fastened to the seal box such that tighter axial and radial fits at the joints are maintained over prior art designs.

The inner vane platform 316 is also held radially by the seal box 500 through hooks 522 that extend from the first aft radially outward extending wall 512 and the first forward radially extending wall 504. The hooks 522 extend laterally and engage slots 524 in the forward face 307*a* and aft face 307*b* of the inner vane platform 316. To further reduce wearing at the interface between the slots 524 and hooks 522, an anti-fretting coating is applied to the contact surfaces of the hooks 522 and slots 524. One such type of anti-fretting coating is an Aluminum Bronze coating. Applying the wear coating to both surfaces creates a uniform wear surface between the inner vane platform 316 and the hooks 522. To minimize any leakage around these interfaces, the hooks 522 and radially-extending walls 504 and 512 are designed to have a limiting axial fit against the inner platform 316 as well as a limiting radial fit with the flange 344.

Figure 15:
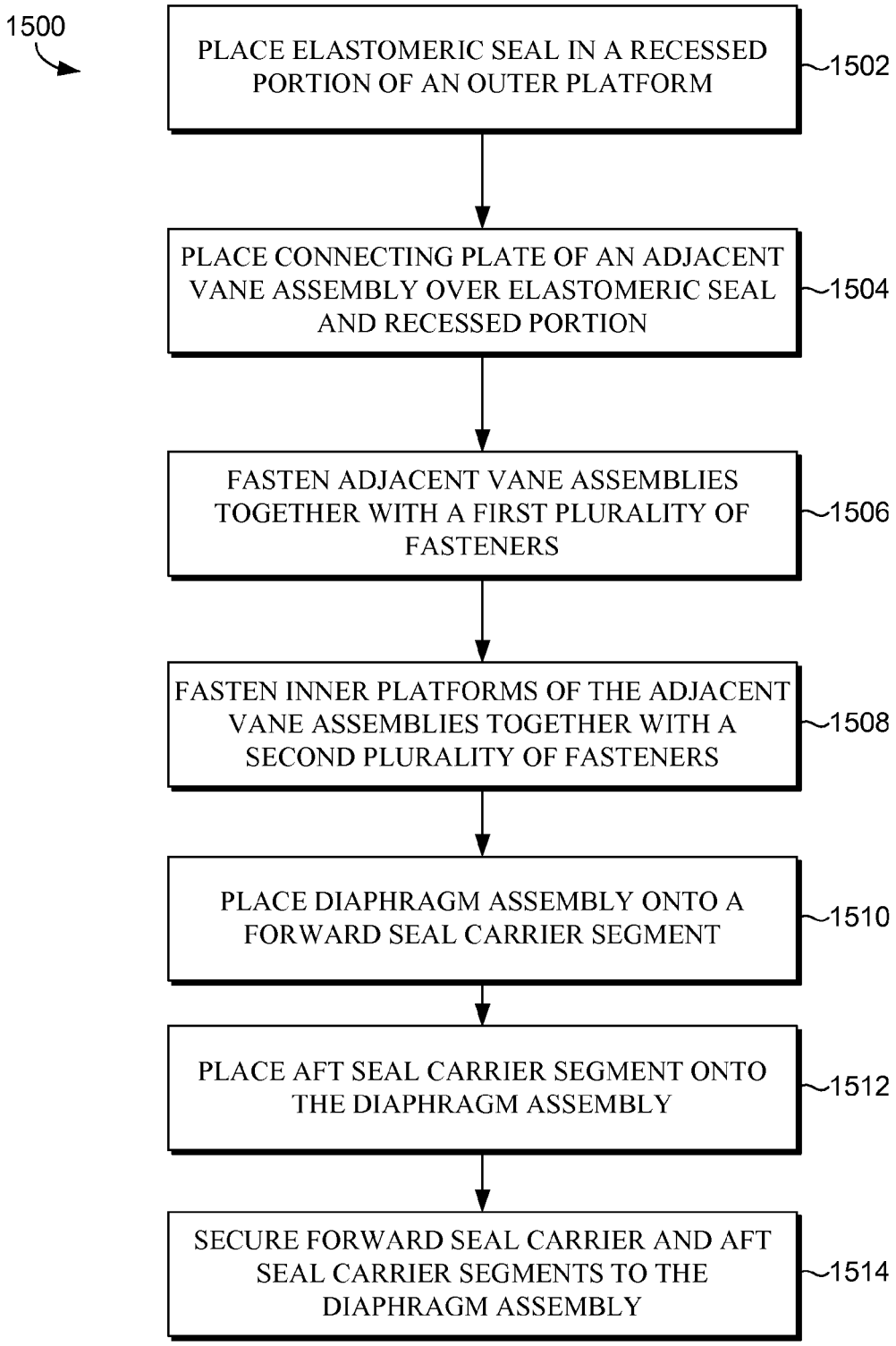

In yet another embodiment of the present invention, a method of assembling a compressor diaphragm is disclosed. Referring to FIG. 15, the method 1500 comprises a step 1502 in which an elastomeric seal is placed in a recessed portion of an outer vane platform of a vane assembly. In a step 1504, the connecting plate of an adjacent vane assembly is placed over the elastomeric seal and recessed portion of the vane assembly. Then, in a step 1506, the outer vane platforms of adjacent vane assemblies are fastened together with a first plurality of fasteners. In a step 1508, the inner platforms of the adjacent vane assemblies are secured together with a second plurality of fasteners to form a diaphragm assembly. The diaphragm assembly is then placed onto a forward seal carrier segment in a step 1510. A hook portion of the forward seal carrier segment interfaces with a slot in the forward face of the inner platforms. Then, in a step 1512, an aft seal carrier segment is placed onto the diaphragm assembly such that a hook portion of the aft seal carrier segment engages with a slot in the aft face of the inner platforms. The forward seal carrier and aft seal carrier segments are then secured to the diaphragm assembly in a step 1514.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A vane pack assembly comprising:

a plurality of vane assemblies positioned adjacent to each other, each vane assembly comprising:

an outer vane platform having a first sidewall and an opposing second sidewall;

an inner vane platform spaced radially inward of the outer platform relative to a central axis;

one or more airfoils extending between the inner platform and the outer platform;

a connecting plate extending from the first sidewall and circumferentially towards the second sidewall of an adjacent vane assembly such that the connecting plate extends over a portion of the outer vane platform of the adjacent vane assembly, the connecting plate having a plurality of radially-extending through holes;

a seal positioned between the connecting plate and the outer platform, the seal having a plurality of openings corresponding to a plurality of through holes in the outer platform;

a first plurality of fasteners passing through the plurality of holes in the connecting plate and secured within the plurality of holes in the outer platform to secure the connecting plate of a vane assembly to a portion of the adjacent vane assembly; and, a forward seal carrier and an aft seal carrier positioned proximate the inner platform and having a second plurality of fasteners for securing the forward seal carrier and the aft seal carrier to the plurality of vane assemblies.

2. The vane pack assembly of claim 1, wherein the outer platform further comprises a recessed portion adjacent the second sidewall such that the connecting plate of the outer vane platform extends from the first sidewall and is positioned within the recessed portion of the outer vane platform of an adjacent vane assembly.

3. The vane pack assembly of claim 2, wherein a joint created between adjacent vane assemblies at an interface of the connecting plate and the recessed portion maintains a constant radius of curvature between the adjacent vane assemblies.

4. The vane pack assembly of claim 1, wherein the outer platform further comprises a recessed portion adjacent the first sidewall and the second sidewall such that the connecting plate of the outer vane platform is positioned within the recessed portions adjacent the first sidewall and adjacent the second sidewall and is secured to the outer platform.

5. The vane pack assembly of claim 1, wherein the first sidewall and second sidewall of the outer platform have adjacent radially extending edges such that the seal is oriented generally vertically between the edges and one or more fasteners pass through the radially extending edges.

6. The vane pack assembly of claim 1, wherein the second plurality of fasteners are generally perpendicular to the first plurality of fasteners.

7. The vane pack assembly of claim 1 further comprising a hook portion on a first forward radially extending wall of the forward seal carrier and a hook portion on a first aft radially outward extending wall for engaging slots in the inner vane platform.

* * * * *